US008736179B2

(12) United States Patent
Chen

(10) Patent No.: US 8,736,179 B2
(45) Date of Patent: May 27, 2014

(54) LIGHTING APPARATUS WITH HYBRID POWER SUPPLY DEVICE, AND METHOD UTILIZING THE SAME

(76) Inventor: Chia-Teh Chen, Taipei (TW)

( * ) Notice: Subject to any disclaimer, the term of this patent is extended or adjusted under 35 U.S.C. 154(b) by 612 days.

(21) Appl. No.: 13/013,908

(22) Filed: Jan. 26, 2011

(65) Prior Publication Data

US 2012/0188752 A1 Jul. 26, 2012

(51) Int. Cl.
*H05B 37/02* (2006.01)

(52) U.S. Cl.
USPC ..... 315/149; 315/154; 315/308

(58) Field of Classification Search
USPC ..... 315/149–159, 291, 297, 307–308; 362/20, 183, 157
See application file for complete search history.

(56) References Cited

U.S. PATENT DOCUMENTS 8,450,964 B2 * 5/2013 Petroianu et al. ..... 320/101
2008/0176608 A1 * 7/2008 Budampati et al. ..... 455/572
2010/0141153 A1 * 6/2010 Recker et al. ..... 315/149
2011/0068692 A1 * 3/2011 Tian et al. ..... 315/113
2011/0157876 A1 * 6/2011 Wang et al. ..... 362/183

* cited by examiner

*Primary Examiner* — Douglas W Owens
*Assistant Examiner* — Henry Luong
(74) *Attorney, Agent, or Firm* — Rosenberg, Klein & Lee

(57) ABSTRACT

A light apparatus with a hybrid power supply device and method utilizing the same are disclosed. The light apparatus includes an LED module, a solar module, an auxiliary power module, a voltage level detection circuit, a first switch unit, and a second switch unit. When a voltage of a solar electric power generated by the solar module is greater than a predetermined value, the voltage level detection circuit provides an electrical connection between the solar module and the LED module for enabling a transmission of the solar electric power to the LED module. When the voltage of the solar electric power is smaller than the predetermined value, the voltage level detection circuit provides an electrical connection between the auxiliary power module and the LED module for enabling a transmission of an auxiliary electric power generated by the auxiliary power module to the LED module.

15 Claims, 6 Drawing Sheets

LIGHTING APPARATUS WITH HYBRID POWER SUPPLY DEVICE, AND METHOD UTILIZING THE SAME

BACKGROUND OF THE INVENTION

1. Field of the Invention

The present disclosure relates to a lighting apparatus, especially to a lighting apparatus with a hybrid power supply device and a method utilizing the same.

2. Description of Related Art

Solar power supply has been adopted as an environmental-friendly source for powering lighting apparatus such as light-emitting diode (LED). However, the amount of electric power that could be provided by the solar power supply is limited by factors including intensity and length of sun light. If it's a cloudy day or the day length is not long enough, the electric power stored in the power storage unit of the solar power supply may not be sufficient enough to drive the LED.

Conventional lighting devices may be a combination of a solar module and wind a power module. The electric power generated by the solar module and the wind power module is stored in rechargeable batteries, for providing requisite electric power to the LED. However, if the daylight intensity and wind force are not sufficient enough at the same time, the solar module and the wind power module may stop operating. That is, using solar and wind power modules together for power supply may still be influenced by weather conditions, failing to ensure the continuity of the delivery of the electrical power to the lighting device.

SUMMARY OF THE INVENTION

An exemplary embodiment according to the present disclosure describes a lighting apparatus, a hybrid power supply device and method utilizing the same, for providing a stable power source.

The apparatus disclosed in one embodiment of the present disclosure includes a light-emitting diode (LED) module, a solar module, an auxiliary power module, and an electric power selection circuit. The solar module is electrically selectable connecting to the LED module. The auxiliary power module is connected to an exterior power source, and also electrically selectable connecting to the LED module. The electric power selection circuit is electrically connected to the solar module, the auxiliary power module, and the LED module.

The solar module is for receiving light energy and converting the light energy into electrical energy, in order to generate a solar electric power. The generated solar electric power is then transmitted to LED module. The auxiliary power module is for receiving the power of an exterior power source and transmitting an auxiliary electric power to the LED module. The electric power selection circuit is for determining whether to provide the solar electric power or the auxiliary electric power to the LED module.

According to another exemplary embodiment of the present disclosure, a hybrid power supply device is provided. The device includes a solar module, an auxiliary power module, and an electric power selection circuit. The hybrid power supply device is electrically connected to a power utilizing load. The auxiliary power module is electrically connected to an exterior power source. The electric power selection circuit is electrically connected to the solar module, the auxiliary power module, and the power utilizing load.

The solar module is for receiving light energy and converting the light energy into electrical energy, in order to output a solar electric power. The auxiliary power module is for receiving the power of the exterior power source to generate an auxiliary electric power. The electric power selection circuit is for determining whether to provide the solar electric power or the auxiliary electric power to the power utilizing load.

According to still another exemplary embodiment of the present disclosure, a hybrid power supply method is presented. The method is associated with a hybrid power supply device for providing electric power to an LED module. The device includes a solar module, an auxiliary power module, a first switch unit, a second switch unit, and a voltage level detection circuit. The first switch unit is electrically connected between the solar module and the LED module, and the second switch unit is electrically connected between the auxiliary power module and the LED module. The hybrid power supply method includes comparing a voltage of a solar electric power generated by the solar module with a predetermined value by the voltage level detection circuit, for generating a comparison result. In addition, the method further includes controlling the first switch unit and the second switch unit according to the comparison result by the voltage level detection circuit, for determining whether to provide the solar electric power generated by the solar module or an auxiliary electric power generated by the auxiliary power module to the LED module.

As mentioned above, the exemplary embodiments according to the present disclosure relate to the hybrid power supply capable of providing stable electric power to LED module.

For further understanding of the invention, reference is made to the following detailed description illustrating the embodiments and examples of the invention. The description is only for illustrating the invention, not for limiting the scope of the claim.

BRIEF DESCRIPTION OF THE DRAWINGS

The drawings included herein provide further understanding of the invention. A brief introduction of the drawings is as follows.

DETAILED DESCRIPTION OF THE PREFERRED EMBODIMENTS

Figure 1:
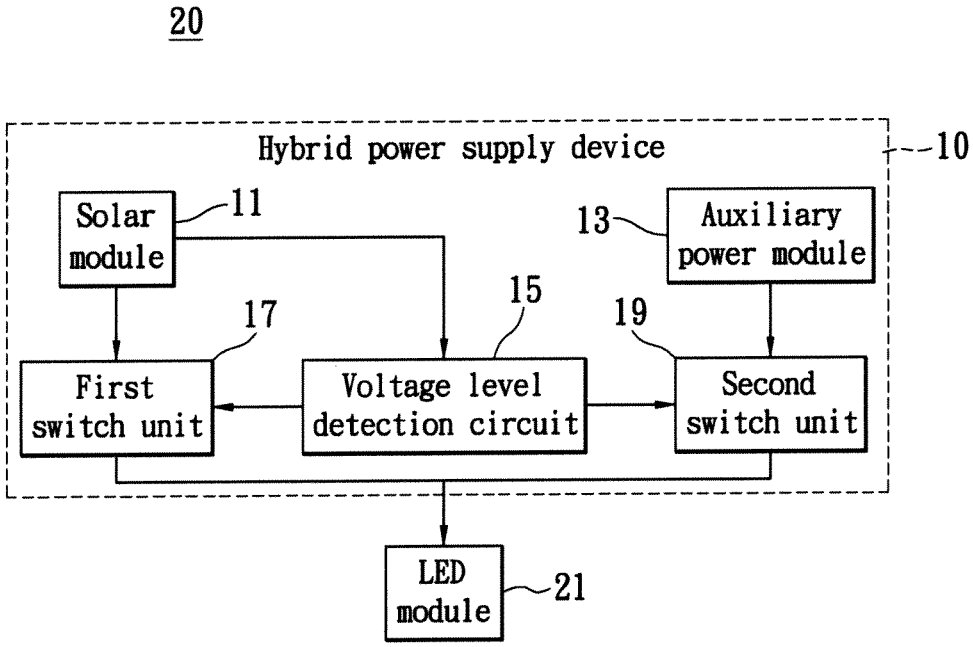
FIG. 1 is a block diagram of a lighting apparatus with a hybrid power supply according to an exemplary embodiment of the present disclosure.

Refer to FIG. 1. FIG. 1 is a block diagram of a lighting apparatus 20 with a hybrid power supply according to an exemplary embodiment of the present disclosure. The lighting apparatus 20 includes a hybrid power supply device 10 and a light-emitting diode (LED) module 21. The hybrid power supply device 10 further has a solar module 11, an auxiliary power module 13, a voltage level detection circuit 15, a first switch unit 17, and a second switch unit 19. The solar module 11 and the auxiliary power module 13 are connected to the LED module 21 through the first switch unit 17 and the second switch unit 19, respectively. The first switch unit 17 is electrically connected between the solar module 11 and the LED module 21, and the second switch unit 19 is electrically connected between the auxiliary power module 13 and the LED module 21. The voltage level detection circuit 15 is electrically connected to the solar module 11, the first switch unit 17, and the second switch unit 19.

In the present embodiment, the solar module 11 is for converting light energy into electrical energy, in order to provide electric power to the LED module 21. The auxiliary power module 13 is connected to an exterior power source that may be an alternative current (AC) or a direct current (DC) power source. The auxiliary power module receives the electric power transmitted from the exterior power source for generating a DC auxiliary electric power, in order to provide requisite operating electric power to the LED module 21 when the voltage of a solar electric power generated by the solar module 11 is not enough. The LED module 21 is used as an example of a power utilizing load of the hybrid power supply device 10. However, although FIG. 1 involves the LED module 21 as a power utilizing load, the power utilizing load of the present disclosure is not limited to the LED module 21.

The voltage level detection circuit 15 is configured to turn on or turn off the first switch unit 17 and the second switch unit 19 according to a voltage delivered by the solar module 11, for determining whether to transmit the solar electric power generated by the solar module 11 or the DC auxiliary electric power generated by the auxiliary power module 13 to the LED module 21.

For example, when the voltage level detection circuit 15 detects that the voltage delivered by the solar module 11 is smaller than a predetermined value, the voltage level detection circuit 15 turns off the first switch unit 17. As such, the connection between the solar module 11 and the LED module 21 is cut off. At the same time, the voltage level detection circuit 15 turns on the second switch unit 19, for facilitating an electrical connection between the auxiliary power module 13 and the LED module 21. Therefore, the hybrid power supply device 10 may provide the requisite electric power to the LED module 21 by the auxiliary power module 13. On the other hand, when the voltage level detection circuit 15 detects the voltage delivered by the solar module 11 is greater than the predetermined value, the first switch unit 17 is turned on while the second switch unit 19 is turned off. Thus, the connection between the auxiliary power module 13 and the LED module 21 is cut off, and the solar electric power generated by the solar module 11 may be provided to the LED module 21. In other words, the hybrid power supply device 10 may provide the requisite electric power to the LED module through the solar module 11.

Figure 2:
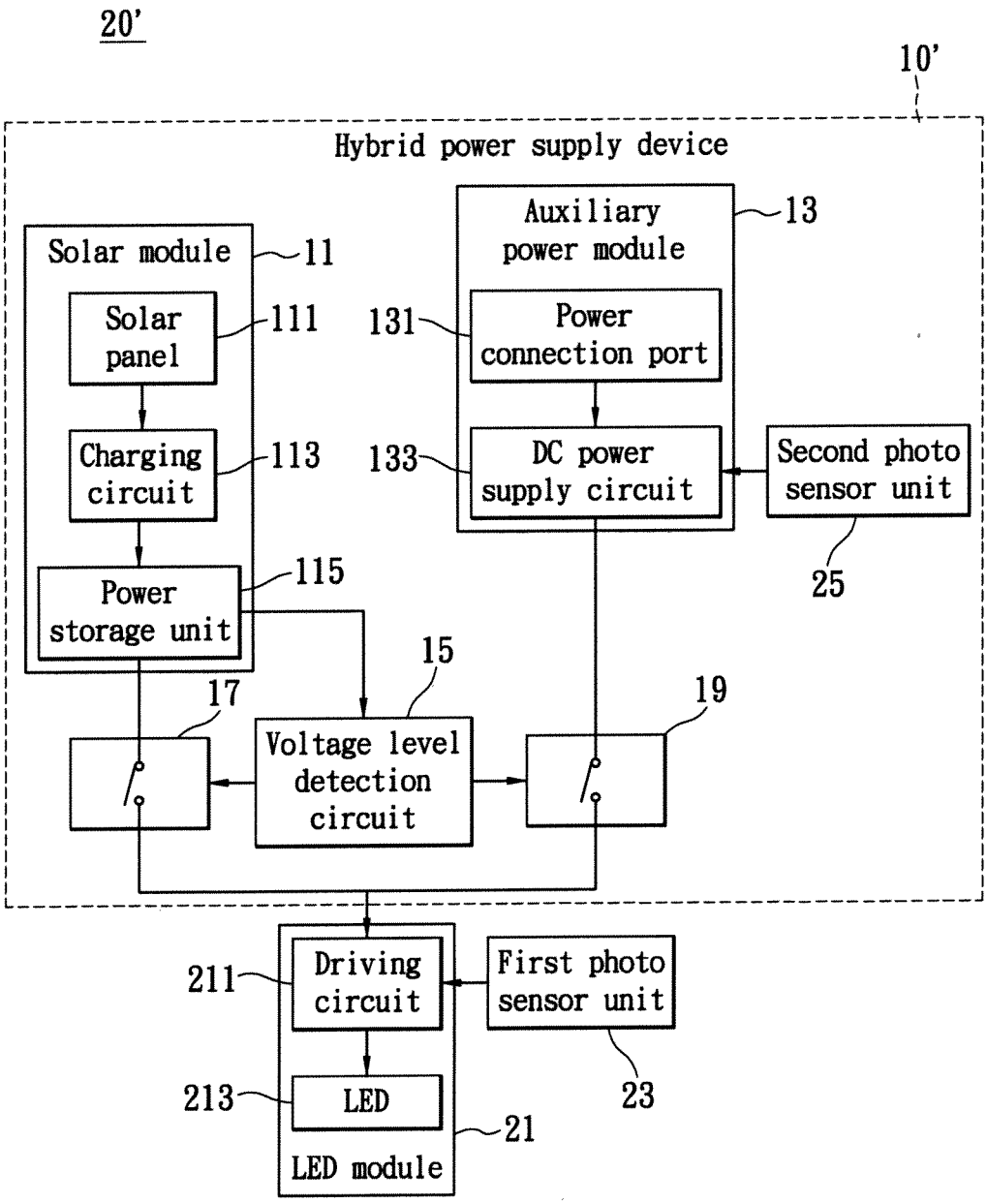
FIG. 2 and FIG. 2A are block diagrams of a lighting apparatus with a hybrid power supply according to another exemplary embodiment of the present disclosure.
Figure 2A:
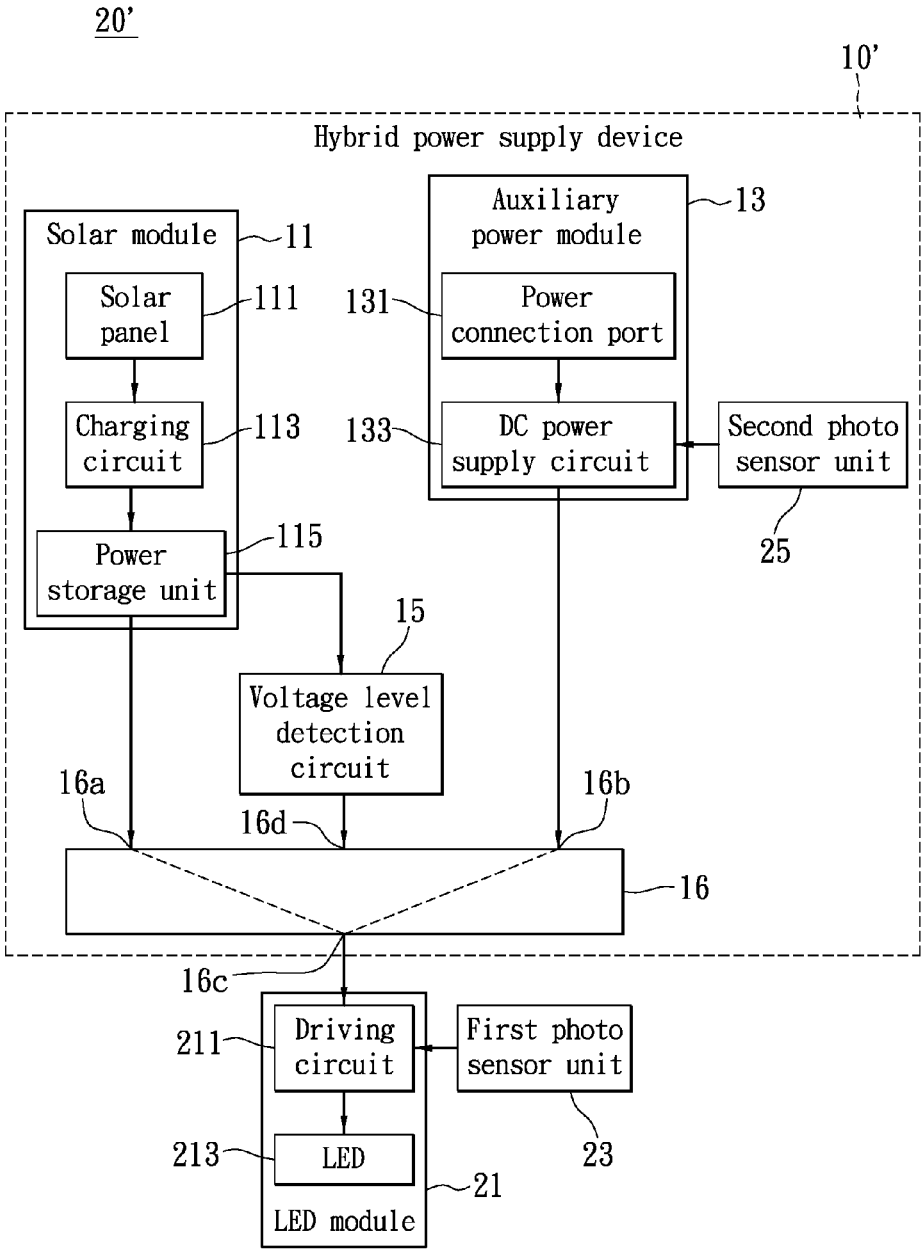

Additionally, in another embodiment, the first switch unit 17 and the second switch unit 19 may be replaced by a 2-to-1 multiplexer 16 having a first input end 16*a*, a second input end 16*b*, a control end 16*d*, and an output end 16*c* shown in FIG. 2A. The first input end 16*a* is electrically connected to the solar module 11, while the second input end 16*b* is electrically connected to the auxiliary power module 13. Also, the control end 16*d* is electrically connected to the voltage level detection circuit 15, with the output end 16*c* is electrically connected to the LED module 21. The voltage level detection circuit 15 generates a selection signal to the control end 16*d* according to the voltage delivered by the solar module 11. After the control end 16*d* receives the selection signal, the multiplexer 16 generates a link connecting the output end 16*c* with the first input end 16*a*, or with the second input end 16*b*. More specifically, if the comparison result indicates that the voltage of the solar electric power is greater than the predetermined value, the multiplexer 16 generates a first link connecting the output end 16*c* with the first input end 16*a*, otherwise the multiplexer 16 generates a second link connecting the output end 16*c* with the second input end 16*b*.

More specifically, the voltage level detection circuit 15, the first switch unit 17, and the second switch unit 19 may serve as an electric power selection circuit. The electric power selection circuit may be used to determine whether the solar electric power or the auxiliary electric power would be delivered to the LED module 21. Although FIG. 1 only shows the voltage level detection circuit 15, the first switch unit 17, and the second switch unit 19 for implementing the electric power selection circuit, the implementation of the electric power selection circuit is not limited as such.

Moreover, the hybrid power supply device 10 may further include power modules other than the solar module 11 and the auxiliary power module 13. In one implementation, the hybrid power supply device 10 may have a wind power module.

Refer to FIG. 2. FIG. 2 is a block diagram of a lighting apparatus 20' with a hybrid power supply according to another exemplary embodiment of the present disclosure. The lighting apparatus 20' with the hybrid power supply includes a hybrid power supply device 10' and an LED module 21. The hybrid power supply device 10' has a solar module 11, an auxiliary power module 13, a voltage level detection circuit 15, a first switch unit 17, and a second switch unit 19. The solar module 11 includes a solar panel 111, a charging circuit 113, and a power storage unit 115. The auxiliary power module 13 includes a power source connection port 131 and a direct current (DC) power supply circuit 133. The LED module 21 includes a driving circuit 211 and at least one LED 213.

The solar module 11 and the auxiliary power module 13 are connected to the LED module 21 through the first switch unit 17 and the second switch unit 19, respectively. The first switch unit 17 is electrically connected between the solar module 11 and the LED module 21, and the second switch unit 19 is electrically connected between the auxiliary power source 13 and the LED module 21. The voltage level detection circuit 15 is electrically connected to the solar module 11, the first switch unit 17, and the second switch unit 19. The solar panel 111 is electrically connected to the charging circuit 113, the charging circuit 113 is electrically connected to the power storage unit 115, and the power storage unit 115 is electrically connected to the first switch unit 17 and the voltage level detection circuit 15. The DC power supply circuit 133 is electrically connected to the power source connection port 131 and the second switch unit 19. The driving circuit 211 is electrically connected to the first switch unit 17, the second switch unit 19, and the LED 213.

The solar panel 111 is a device for implementing an optical-to-electrical conversion. Light energy is converted into electrical energy by the solar panel 111, and the generated electrical energy is then transmitted and stored in the power storage unit 115 by the charging circuit 113. In one implementation, the power storage unit 115 is a rechargeable battery. The charging circuit 113 may have a diode (not shown in FIG. 2) for avoiding the electric power stored in the power storage unit 115 from flowing back to solar panel 111.

The power source connection port 131 is for connecting an AC or a DC exterior power source, and transmitting the electric power to the DC power supply circuit 133. The DC power supply circuit 133 may also include a transformer and a rectifier, both of which could handle the AC power input if the power source connection port 131 connects to the AC power source. The DC power supply circuit 133 is for generating an operating voltage of the hybrid power supply device 10', and for generating the auxiliary electric power provided to the LED module 21. In one implementation, the auxiliary electric power is a DC power.

The driving circuit 211 may be a driving IC for the LED 213. The driving circuit 211 receives the solar electric power transmitted from the solar module 11 or the auxiliary electric power transmitted from the auxiliary power module 13, for driving the LED 213. The voltage level detection circuit 15 compares the voltage of the solar electric power with the predetermined value before controlling operations of the first switch unit 17 and the second switch unit 19. Therefore, whether the solar electric power or the auxiliary electric power is transmitted to the driving circuit 211 may be determined.

In addition, the lighting apparatus 20' may further have a first photo sensor unit 23 and a second photo sensor unit 25. The first photo sensor unit 23 is electrically connected to the driving circuit 211, and the second photo sensor unit 25 is electrically connected to the DC power supply circuit 133. The first photo sensor unit 23 is for detecting an environmental light intensity, and for stopping the driving circuit 211 from operating when the environmental light intensity is greater than a predetermined first threshold value. Thus, the LED module 21 may not operate in an environmental with the environmental light intensity being strong enough. Similarly, the second photo sensor unit 25 is for stopping the DC power supply circuit 133 from providing the electric power when the environmental light intensity is greater than a predetermined second threshold value. Consequently, with the thresholds in place unexpected power waste may be reduced.

Figure 3:
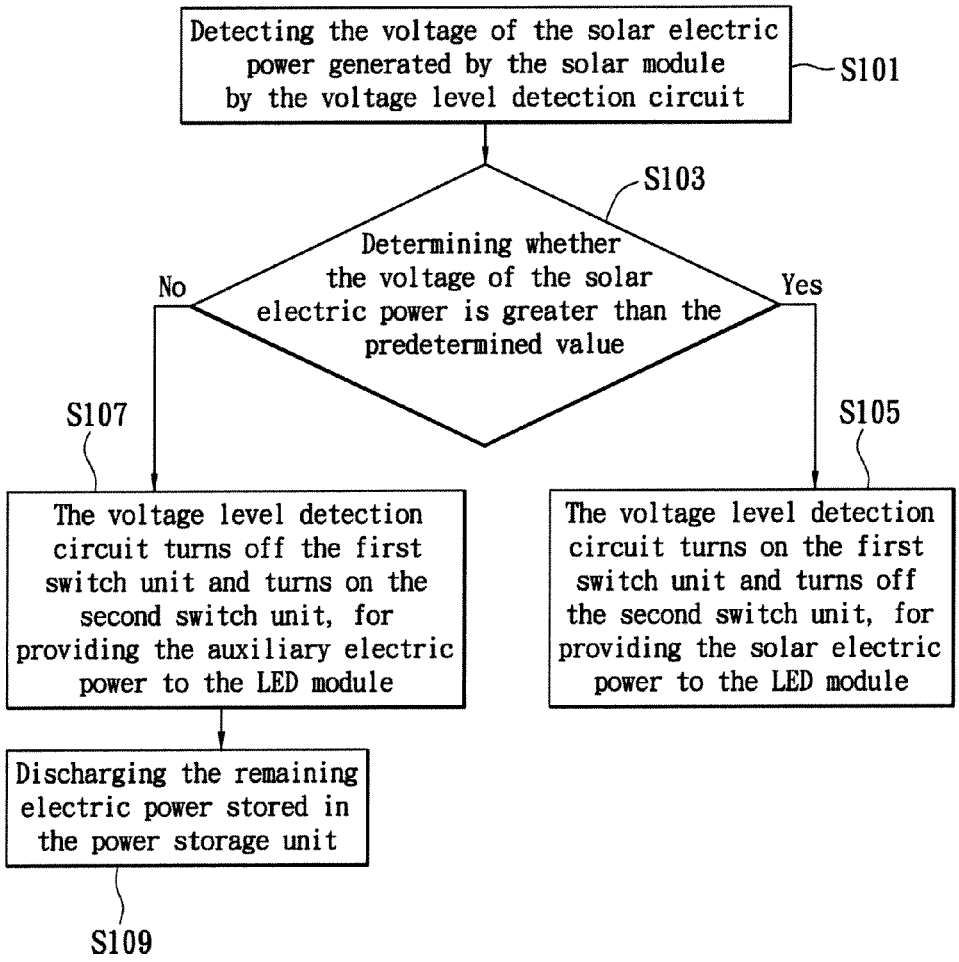
FIG. 3 is a flow chart of a method for operating a hybrid power supply according to an exemplary embodiment of the present disclosure.

In conjunction with FIG. 1, refer to FIG. 3. FIG. 3 is a flow chart of a method for operating a hybrid power supply according to an exemplary embodiment of the present disclosure. The method includes detecting the voltage of the solar electric power generated by the solar module 11 (S101) by the voltage level detection circuit 15. The method further include determining whether the voltage of the solar electric power is greater than a predetermined value by the voltage level detection circuit 15 (S103), before generating a comparison result. When the voltage of the solar electric power is greater than the predetermined value, the electric power stored in the power storage unit 115 of the solar module 11 may be considered sufficient enough for providing the requisite electric power to the LED module 21. When the voltage of the solar electric power is greater than the predetermined value, the method of the present disclosure may cause the voltage level detection circuit 15 to turn on the first switch unit 17 and to turn off the second switch unit 19, for providing the solar electric power to the LED module 21 (S105).

On the other hand, when the voltage of the solar electric power is smaller than the predetermined value the amount of electric power stored in the power storage unit 115 may not be sufficient enough for providing the requisite electric power to the LED module 21. Thus, the method of the present disclosure may cause the voltage level detection circuit 15 to turn off the first switch unit 17 and to turn on the second switch unit 19, for providing the auxiliary electric power generated by the auxiliary power module 13 to the LED module 21 (S107). When the hybrid power supply device 10 utilizes the auxiliary power module 13 to provide the requisite electric power, the hybrid power supply method may further includes discharging the power storage unit 115 by a power leakage unit (S109). Discharging the remaining power of the power storage unit 115 is for avoiding the memory effect which may occur in the power storage unit 115. The memory effect of some rechargeable batteries may result in a reduction of the number of times the power storage unit 115 could be recharged.

Figure 4:
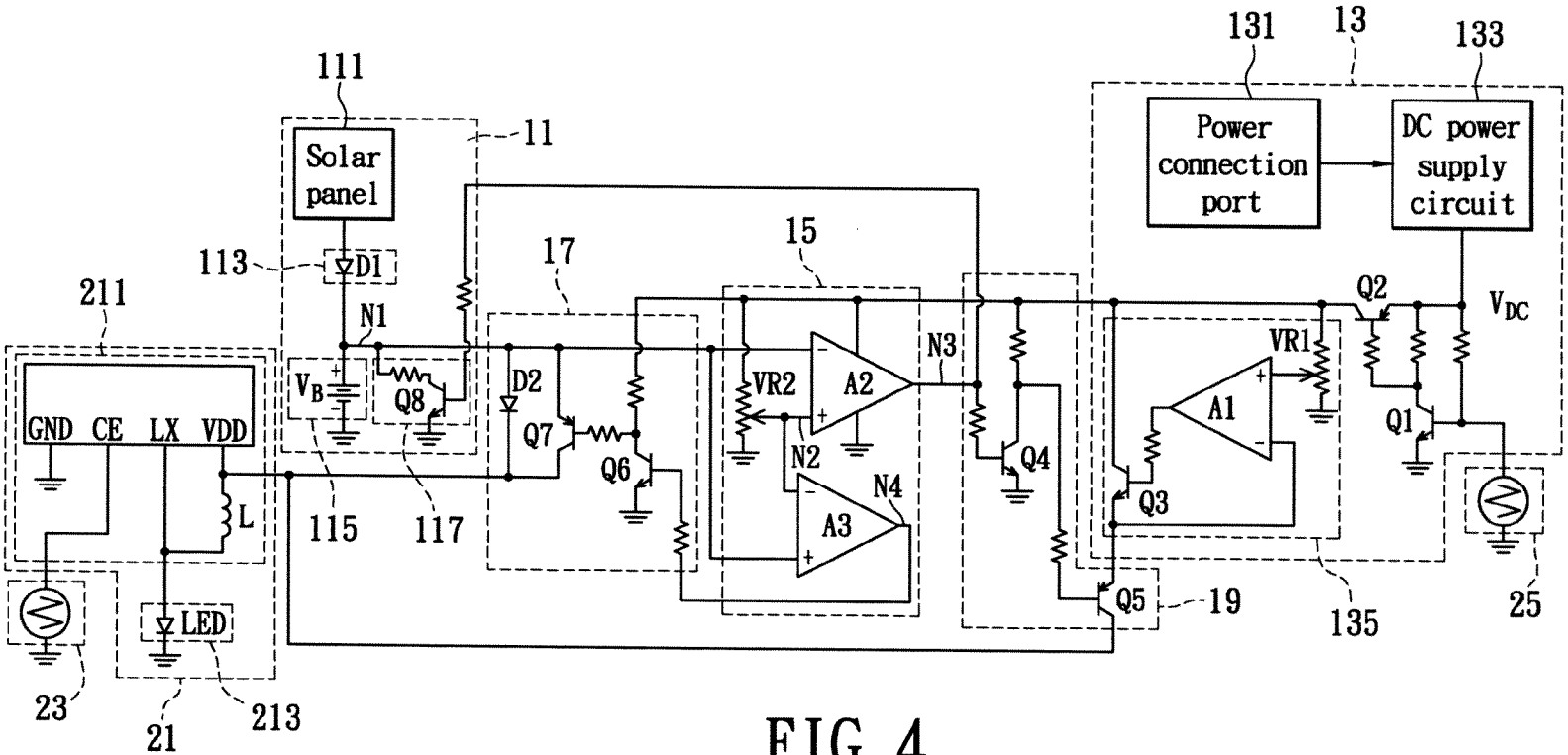
FIG. 4 is a circuit diagram of a lighting apparatus with a hybrid power supply according to an exemplary embodiment of the present disclosure.

Refer to FIG. 4. FIG. 4 is a circuit diagram of a lighting apparatus with a hybrid power supply according to an exemplary embodiment of the present disclosure. As shown in FIG. 4, the charging circuit 113 of the solar module 11 may be a diode $D_1$, and the power storage unit 115 may be a rechargeable battery. The rechargeable battery has one end connected to ground and another end connected to the diode $D_1$, and designated as high voltage level node $N_1$. The potential difference between the ground and the high voltage level node $N_1$ is the output voltage of the rechargeable battery, namely, the voltage of the solar electric power described above. Suppose the voltage of the fully charged rechargeable battery is $V_{B0}$ and at the time of detection the voltage of the rechargeable battery is $V_B$, which is supposed to be equal to or less than the voltage $V_{B0}$. The high voltage level node $N_1$ is connected to an inverting input of the amplifier $A_2$ in the voltage level detection circuit 15, so that the voltage level detection circuit 15 may detect the voltage $V_B$. It is worth noting that the placement of the diode $D_1$ may avoid the electric power stored in the power storage unit 115 from flowing back to the solar panel 111.

The auxiliary power module 13 may further include a voltage adjusting circuit 135. The voltage adjusting circuit 135 has an amplifier $A_1$, a transistor $Q_3$, and a variable resistor $VR_1$. The amplifier $A_1$ has a non-inverting input connected to the variable resistor $VR_1$. Further, the amplifier $A_1$ has an inverting input connected to an emitter of the transistor $Q_3$ and an output connected to a base of the transistor $Q_3$ through a resistor for establishing a feedback connection. In addition, a collector of the transistor $Q_3$ is connected to the transistor $Q_2$. The voltage adjusting circuit 135 is for adjusting a voltage level of an output voltage and thus that particular output voltage may be used by the LED module 21. The auxiliary electric power or the adjusted output voltage may then be transmitted to the second switch unit 19. With the voltage adjusting circuit 135, the auxiliary power module 13 may meet different output voltage level of the solar module 11 of different standards.

Additionally, besides connecting to the inverting input of the amplifier $A_1$, the emitter of the transistor $Q_3$ further connects to an emitter of the transistor $Q_5$ in the second switch unit 19. Fixed contacts of the variable resistor $VR_1$ are respectively connected to a collector of transistor $Q_2$ and the ground, and a sliding contact of the variable resistor $VR_1$ is connected to the non-inverting input of the amplifier $A_1$. Accordingly, a voltage divider may be established. When the resistance of the variable resistor $VR_1$ changes, the voltage at the non-inverting input of the amplifier $A_1$ may be adjusted as the result. When the amplifier $A_1$ operates at a linear region, the voltage at the inverting input of amplifier $A_1$ approximately equals to the voltage at the non-inverting input of the amplifier $A_1$. Therefore, if the voltage of the non-inverting input of the amplifier $A_1$ is adjusted to $V_{B0}$ which may correspond to the voltage of the fully charged power storage unit 115, the voltage outputted from the emitter of the transistor $Q_3$ may approximately be the same as the voltage $V_{B0}$. Therefore, the voltage outputted from the auxiliary power module 13 to the second switch unit 19 through transistor $Q_3$ may be regulated for matching different requirements.

The voltage $V_{DC}$ generated from the DC power supply circuit 133 of the auxiliary power module 13 is designed to be greater than the voltage $V_{B0}$ delivered from the solar module 11. In doing so, the voltage $V_{DC}$ could be sufficiently high enough for providing operating voltages for each element in the lighting apparatus and could be also adjusted to the voltage level of $V_{B0}$.

Moreover, as shown in FIG. 4, the auxiliary power module 13 may further include transistors $Q_1$ and $Q_2$, and a photo sensor unit 25, for controlling the transmission of the generated DC voltage $V_{DC}$. In one implementation, the photo sensor unit 25 may be a light dependent resistor (LDR). When the environmental light intensity is strong, the photo sensor unit 25 may be associated with a low resistance. Therefore, the voltage difference between the base and the emitter node of the transistor $Q_1$ is small. Then, the transistor $Q_1$ is turned off. When the transistor $Q_1$ is off, the current at the collector node of the transistor $Q_1$ is zero and the potential at the base node and the emitter node of the transistor $Q_2$ may be equal to each other, such that the transistor $Q_2$ is also turned off. Because the current flowing from the emitter of the transistor $Q_2$ to the collector thereof is zero, the transmission of voltage $V_{DC}$ may stop. On the other hand, the weak environmental light intensity may associate the photo sensor unit 25 with high resistance. Therefore, the voltage difference between the base node and the emitter node of the transistor $Q_1$ is high. Then, the transistor $Q_1$ is turned on, such that the voltage of the collector node of transistor $Q_1$ is close to ground. Therefore, the voltage difference between the base and the emitter of the transistor $Q_2$ may be sufficient to turn on the transistor $Q_2$. As such, the voltage $V_{DC}$ may be transmitted from the emitter to the collector of the transistor $Q_2$, for providing the operating voltages to the voltage level detection circuit 15, the first switch unit 17, and the second switch unit 19, and further rendering the voltage adjusting circuit 135 to deliver a voltage equal to the voltage $V_{B0}$ of the solar module 11.

Refer to FIG. 4 again. The voltage level detection circuit 15 includes amplifier $A_2$ and $A_3$. An inverting input of the amplifier $A_2$ is connected to the high voltage node $N_1$ which is the output of the solar module 11, and a non-inverting input of the amplifier $A_2$ is connected to the node $N_2$ of a variable resistor $VR_2$. On the contrary, the high voltage node $N_1$ is connected to a non-inverting input of the amplifier $A_3$ while and an inverting input of the amplifier $A_3$ is connected to the node $N_2$ of the variable resistor $VR_2$. In addition, the first switch unit 17 includes transistors $Q_6$ and $Q_7$, and the second switch unit 19 includes transistors $Q_4$ and $Q_5$.

The voltage level detection circuit 15 detects the value of the voltage $V_B$ of the solar module 11, and sets the first switch unit 17 and the second switch unit 19 on or off, respectively, according to the detected value of the voltage $V_B$. The voltage provided by node $N_2$ may serve as the predetermined value, which may be compared with the voltage $V_B$. The voltage at node $N_2$ may be considered as a minimum requisite voltage for the driving circuit 211 of the LED module 21, and may be adjusted by the variable resistor $VR_2$. Generally, the voltage of the node $N_2$ may be set to 0.7 times of the voltage $V_{B0}$. Of course, the voltage of the node $N_2$ may be set to any other value depending on practical needs or design schemes.

Additionally, an output node $N_3$ of the amplifier $A_2$ is connected to a base node of the transistor $Q_4$ of the second switch unit 19 through a resistor. In the second switch unit 19, an emitter of the transistor $Q_4$ is connected to the ground, and a collector of the transistor $Q_4$ is connected to a base of the transistor $Q_5$ and through a resistor to the voltage $V_{Dc}$. An emitter of transistor $Q_5$ is connected to the transistor $Q_3$ of the auxiliary power module 13, and a collector of transistor $Q_5$ is connected to the driving circuit 211 of the LED module 21. The non-inverting input of the amplifier $A_3$ is also connected to the high voltage level node N1, and the inverting input of the amplifier $A_3$ to the node $N_2$ of the variable resistor $VR_2$. Further, an output node $N_4$ of the amplifier $A_3$ is connected to a base of the transistor $Q_6$ of the first switch unit 17 through a resistor. In the first switch unit 17, an emitter of the transistor $Q_6$ is connected to the ground, and a collector of the transistor $Q_6$ is connected through a resistor to the voltage $V_7$ and also through a resistor to a base of the transistor $Q_7$. An emitter of the transistor $Q_7$ is connected to the high voltage level node $N_1$, and a collector of the transistor $Q_7$ is connected to the driving circuit 211.

When the solar electric power provided by the solar module 11 is sufficient, namely, at the time the voltage $V_B$ of the solar electric power is greater than the predetermined value provided by the node $N_2$, the voltage of output node $N_4$ of the amplifier $A_3$ is "high". This turns on the transistor $Q_6$ that is connected to $N_4$. Then, the voltage at the base node of transistor $Q_7$ is low. As such, the transistor $Q_7$ is turned on also. Therefore, the voltage $V_B$ of the solar electric power is transmitted from the solar module 11 to the driving circuit 211 of the LED module 21 through the first switch unit 17.

When the voltage $V_B$ of the solar electric power is greater than the predetermined value provided by the node $N_2$, the voltage of the output node $N_3$ of the amplifier $A_2$ is "low". Thus, the transistor $Q_4$ is turned off, and the voltage of the base of the transistor $Q_5$ is high, turning off the transistor $Q_5$ as the result. And therefore the connection between the auxiliary power module 13 and the driving circuit 211 of the LED module 21 is cut off by the second switch unit 19.

On the other hand, when the solar electric power provided by the solar module 11 is insufficient, (i.e., when the voltage $V_B$ of the solar electric power is smaller than the predetermined value provided by the node $N_2$) the voltage of the output node $N_4$ of amplifier $A_3$ is "low." As such, the transistors $Q_6$ and $Q_7$ are turned off, effectively disconnecting the solar module 11 from the driving circuit 211 of the LED module 21.

When the voltage $V_B$ of the solar electric power is smaller than the predetermined value provided by the node $N_2$, the voltage of the output node $N_3$ of the amplifier $A_2$ is "high." Thus, the transistor $Q_4$ is turned on, and the voltage of the base of the transistor $Q_5$ is low. Then, the transistor $Q_5$ is turned on. Since the transistor $Q_5$ is connected to the transistor $Q_3$, the voltage at the emitter of the transistor $Q_3$, which is set to the value of $V_{B0}$ by the operation of the voltage adjusting circuit 135 described above, may be transmitted through the transistor $Q_5$. Consequently, the auxiliary power module 13 may transmit the auxiliary electric power of the voltage $V_{B0}$ to the driving circuit 211 of LED module 21 through the second switch unit 19.

Briefly speaking, when the output voltage $V_B$ of the solar module 11 is greater than the predetermined value provided by the node $N_2$, the hybrid power supply device 10 may turn to the solar module 11 for providing the electric power to the LED module 21. On the other hand, when the output voltage $V_B$ of the solar module 11 is smaller than the predetermined value provided by the node $N_2$, the hybrid power supply device 10 utilizes the auxiliary power module 13 for providing the electric power to the LED module 21. It is worth noting that the predetermined value provided by the node $N_2$ may be set to the minimum requisite voltage for driving the LED module 21, or may be set to any other value according to practical needs or design schemes.

In addition, in this exemplary embodiment, the solar module 11 may further include a power leakage unit 117, for protecting the power storage unit 115 which may be a rechargeable Ni—Cd battery in one implementation. As shown in FIG. 4, the power storage unit 115 of the solar module 11 is parallel connected with the power leakage unit 117 which includes a transistor $Q_8$ and a resistor. A base node of the transistor $Q_8$ is connected to the output node $N_3$ of the amplifier $A_2$ of the voltage level detection circuit 15 through another resistor. When the voltage $V_B$ of the solar electric power delivered by the solar module 11 is greater than the predetermined value provided by the node $N_2$, the output node $N_3$ of the amplifier $A_2$ may yield a "low" voltage to turn off the transistor $Q_8$. In other words, when the output of the solar module 11 maintains a sufficient voltage level, the power leakage unit 117 is turned off.

When the voltage $V_B$ generated by the solar module 11 is smaller than the predetermined value, the output node $N_3$ of the amplifier $A_2$ yields a "high" level voltage to turn on both the second switch unit 19 and the transistor $Q_8$. Therefore, when the auxiliary power module 13 is used for providing the electric power to LED module 21, the remaining electric power stored in the power storage unit 115 may be discharged through the path provided by the transistor $Q_8$. The resistor connected to the collector node of the transistor $Q_8$ in the power leakage unit 117 is for controlling the discharging rate. Consequently, the power leakage unit 117 may serve as a useful means to extend the lifetime of the power storage unit 115.

The first switch unit 17 may further include a diode $D_2$ connected between the emitter and the collector of the transistor $Q_7$. The diode $D_2$ is turned on when the auxiliary power module 13 does not facilitate the connection between the solar module 11 and the LED module 21. The diode $D_2$ is turned off by a reverse bias voltage when the voltage $V_B$ decreases and the second switch unit 19 is turned on. When the first switch unit 17 is turned on, the electric power provided by the solar module 11 may be delivered to the LED module 21 through the transistor $Q_7$. The benefit of providing the diode $D_2$ is that when the auxiliary power module 13 work abnormally and stops providing the electric power to the first switch unit 17, the second switch unit 19, and the voltage level detection unit 15, the solar module 11 may still transmit the solar electric power to the LED module 21 through the diode $D_2$, maintaining the continuity of the delivery of the electric power to the LED module 21.

Furthermore, in the exemplary embodiment presented in FIG. 4, the driving circuit 21 may be implemented by an integrated circuit (IC) of the type ANA618. An operating power node $V_{DD}$ of the IC is connected to the solar module 11 and the auxiliary power module 13 through the first switch unit 17 and the second switch unit 19, respectively. In addition, a node LX of the IC is connected to the LED 213, and is also connected to the node $V_{DD}$ through an inductor. The photo sensor unit 23 is connected to a node CE of the same IC, for controlling the driving circuit 211 to operate only when the environmental light intensity is low. Additionally, the amplifiers A1, A2, and A3 may be implemented by one IC, such as the type LM324, for simplifying the circuit design.

Figure 5:
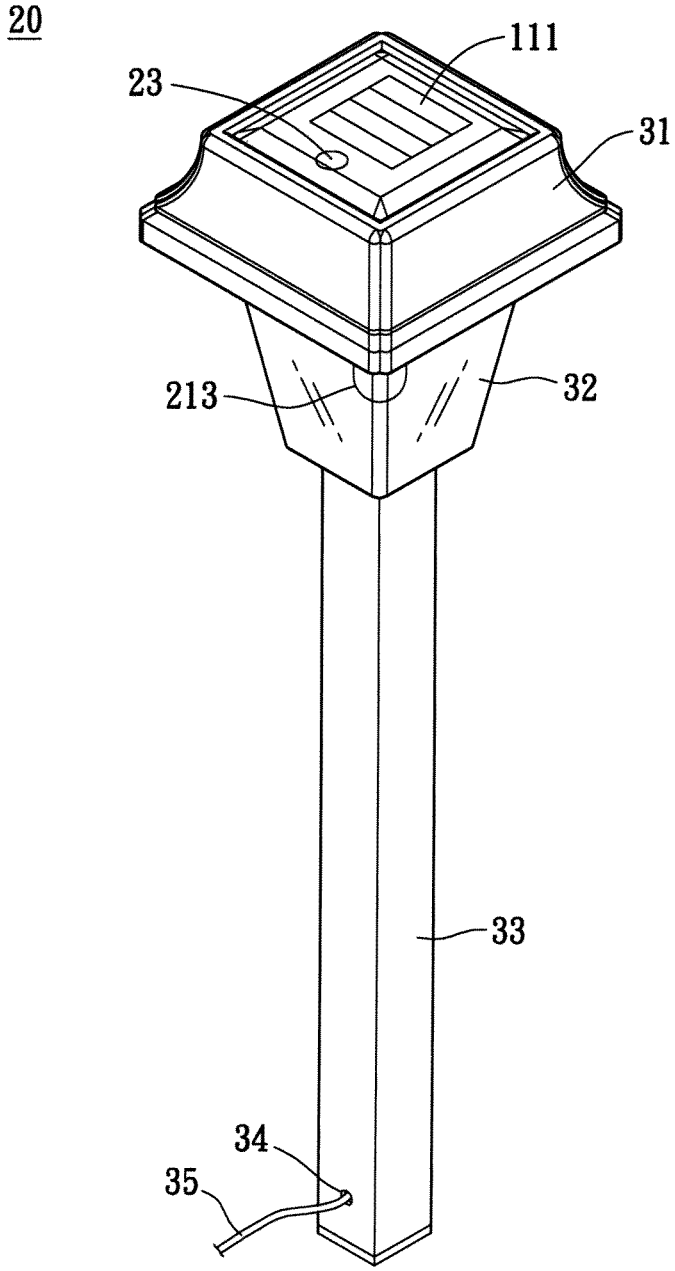
FIG. 5 is a device diagram of a lighting apparatus with a hybrid power supply according to an exemplary embodiment of the present disclosure.

Refer to FIG. 5 and FIG. 4. FIG. 5 is a device diagram of a light apparatus 20 with a hybrid power supply according to an exemplary embodiment of the present disclosure. The lighting apparatus 20 in FIG. 5 is a garden lamp, which includes a solar panel 111, a photo sensor unit 23, an LED 213, a top section 31, a shield 32, a pillar 33, an aperture 34, and a wire 35 of the power connection port 131. The circuit of the hybrid power supply device 10 may be installed in the space between the top section 31 and the shield 32.

The solar panel 111 may convert the light energy into the electrical energy, and transmit the electrical energy to the power storage unit 115, for delivering the solar electric power to power up the LED 213. When the voltage of the solar electric power is too low and cannot provide the requisite electric power to LED 213 for light emitting purpose, the auxiliary power module 13 of the hybrid power supply device 10 may receive power from the wire 35, so as to make the auxiliary electric power ready for the LED 213. In addition, when the photo sensor unit 23 detects that the environmental light intensity is greater than a threshold value, the photo sensor unit 23 may stop the LED 213 from emitting light, for avoiding electric power waste.

Some modifications of these examples, as well as other possibilities will, on reading or having read this description, or having comprehended these examples, will occur to those skilled in the art. Such modifications and variations are comprehended within this invention as described here and claimed below. The description above illustrates only a relative few specific embodiments and examples of the invention. The invention, indeed, does include various modifications and variations made to the structures and operations described herein, which still fall within the scope of the invention as defined in the following claims.

What is claimed is:

1. A lighting apparatus with hybrid power supply, comprising:

a light-emitting diode (LED) module;

a solar module, electrically connected to the LED module, in which the solar module receives a light energy and converts the light energy into electrical energy before outputting a solar electric power and transmitting the solar electric power to the LED module;

an auxiliary power module, electrically connected to the LED module and an exterior power source, in which the auxiliary power module receives a power of the exterior power source and transmits an auxiliary electric power to the LED module; and an electric power selection circuit electrically connected to the LED module, the solar module, and the auxiliary power module, in which the electric power selection circuit determines whether to transmit the auxiliary electric power or the solar electric power to the LED module according to a voltage of the solar electric power;

wherein the electric power selection circuit comprises:

a first switch unit, electrically connected between the LED module and the solar module;

a second switch unit, electrically connected between the LED module and the auxiliary power module; and a voltage level detection circuit, electrically connected to the solar module, the first switch unit, and the second switch unit, in which the voltage level detection circuit compares a voltage of the solar electric power outputted by the solar module with a predetermined value before preparing a comparison result, which serves as a basis for a control of the first switch unit and the second switch unit;

wherein if the comparison result indicates that the voltage of the solar electric power is greater than the predetermined value, the voltage level detection circuit turns on the first switch unit and turns off the second switch unit, otherwise the voltage level detection circuit turns off the first switch unit and turns on the second switch unit.

2. The lighting apparatus as in claim 1, wherein the LED module comprises:

a light-emitting diode (LED); and a driving circuit, electrical connected to the LED, the first switch unit, and the second switch unit, in which the driving circuit receives the solar electric power generated by the solar module or the auxiliary electric power generated by the auxiliary power module to drive the LED to emit light.

3. The lighting apparatus as in claim 1, wherein the solar module comprises:

a solar panel, for receiving the light energy and converting the light energy into the electrical energy;

a power storage unit, electrically connected to the solar panel and the first switch unit, in which the power storage unit receives the electrical energy generated by the solar panel for generating the solar electric power; and a charging circuit, electrically connected between the solar panel and the power storage unit, in which the charging circuit transmits the electrical energy generated by the solar panel to the power storage unit.

4. The lighting apparatus as in claim 3, wherein the solar module further includes a power leakage unit electrically connected to the power storage unit and the voltage level detection circuit, in which the power leakage unit discharges the power storage unit when the first switch unit is turned off and the second switch unit is turned on.

5. The lighting apparatus as in claim 1, wherein the auxiliary power module comprises:

a power source connection port, for connecting the power source; and a direct current (DC) power supply circuit electrically connected to the exterior power source connection port and the second switch unit, in which the DC power supply circuit receives the power of the power source from the exterior power source connection port, for generating the auxiliary electric power and an operating voltage for the electric power selection circuit.

6. The lighting apparatus as in claim 1, further comprising a first photo sensor unit electrically connected to the LED module, in which the first photo sensor unit stops the LED module from operating when the first photo sensor unit detects that an environmental light intensity is greater than a first threshold value.

7. A lighting apparatus with hybrid power supply, comprising:

a light-emitting diode (LED) module;

a solar module, electrically connected to the LED module, in which the solar module receives a light energy and converts the light energy into electrical energy before outputting a solar electric power and transmitting the solar electric power to the LED module;

an auxiliary power module, electrically connected to the LED module and an exterior power source, in which the auxiliary power module receives a power of the exterior power source and transmits an auxiliary electric power to the LED module; and an electric power selection circuit electrically connected to the LED module, the solar module, and the auxiliary power module, in which the electric power selection circuit determines whether to transmit the auxiliary electric power or the solar electric power to the LED module according to a voltage of the solar electric power;

wherein the electric power selection circuit comprises:

a 2-to-1 multiplexer, having a first input end electrically connected to the solar module, a second input end electrically connected to the auxiliary power module, a control end, and an output end electrically connected to the LED module; and a voltage level detection circuit, electrically connected to the solar module and the control end of the 2-to-1 multiplexer, in which the voltage level detection circuit generates a selection signal according to a comparison result of the voltage of the solar electric power outputted by the solar module with a predetermined value, and controls the 2-to-1 multiplexer for outputting the auxiliary electric power or the solar electric power to the LED module according to the selection signal;

wherein if the comparison result indicates that the voltage of the solar electric power is greater than the predetermined value, the multiplexer generates a first link connecting the output end with the first input end, otherwise the multiplexer generates a second link connecting the output end with the second input end.

8. A hybrid power supply device, electrically connected to a power utilizing load, comprising:

a solar module, for receiving a light energy and converting the light energy into an electrical energy, in order to output a solar electric power;

an auxiliary power module electrically connected to an exterior power source, in which the auxiliary power module receives a power of the exterior power source for generating an auxiliary electric power; and an electric power selection circuit electrically connected to the power utilizing load, the solar module, and the auxiliary power module, in which the electric power selection circuit determines whether to output the auxiliary electric power or the solar electric power to the power utilizing load according to a voltage of the solar electric power;

wherein the electric power selection circuit comprises:

a first switch unit electrically connected between the solar module and the power utilizing load;

a second switch unit, electrically connected between the auxiliary power module and the power utilizing load; and a voltage level detection circuit, electrically connected to the solar module, the first switch unit, and the second switch unit, in which the voltage level detection circuit compares a voltage of the solar electric power with a predetermined value for generating a comparison result, and controls the first switch unit and the second switch unit according to the comparison result;

wherein when the comparison result indicates that the voltage of the solar electric power is greater than the predetermined value, the voltage level detection circuit turns on the first switch unit and turns off the second switch unit, otherwise the voltage level detection circuit turns off the first switch unit and turns on the second switch unit.

9. The hybrid power supply device as in claim 8, wherein the solar module comprising:

a solar panel, for receiving the light energy and converting the light energy into the electrical energy;

a power storage unit, electrically connected to the solar panel and the first switch unit, in which the power storage unit receives the electrical energy generated by the solar panel for generating the solar electric power; and a charging circuit, electrically connected between the solar panel and the power storage unit, in which the charging circuit transmits the electrical energy generated by the solar panel to the power storage unit.

10. The hybrid power supply device as in claim 9, wherein the solar module further includes a power leakage unit electrically connected to the power storage unit and the voltage level detection circuit, in which the power leakage unit discharges the power storage unit when the first switch unit is turned off and the second switch unit is turned on.

11. The hybrid power supply device as in claim 8, wherein the auxiliary power module comprises:

a power source connection port, for connecting the exterior power source; and a direct current (DC) power supply circuit electrically connected to the power source connection port and the second switch unit, in which the DC power supply circuit receives the power of the power source from the power source connection port, for generating the auxiliary electric power and an operating voltage for the electric power selection circuit.

12. A hybrid power supply device, electrically connected to a power utilizing load, comprising:

a solar module, for receiving a light energy and converting the light energy into an electrical energy, in order to output a solar electric power;

an auxiliary power module electrically connected to an exterior power source, in which the auxiliary power module receives a power of the exterior power source for generating an auxiliary electric power; and an electric power selection circuit electrically connected to the power utilizing load, the solar module, and the auxiliary power module, in which the electric power selection circuit determines whether to output the auxiliary electric power or the solar electric power to the power utilizing load according to a voltage of the solar electric power;

wherein the electric power selection circuit comprises:

a 2-to-1 multiplexer, having a first input end, a second input end, a control end, and an output end, in which the output end is electrically connected to the power utilizing load, the first input end is electrically connected to the solar module, and the second input end is electrically connected to the auxiliary power module; and a voltage level detection circuit electrically connected to the solar module and the control end of the 2-to-1 multiplexer, in which the voltage level detection circuit generates a selection signal according to a comparison result of the voltage of the solar electric power outputted by the solar module with a predetermined value, and controls the 2-to-1 multiplexer for outputting the solar electric power or the auxiliary electric power to the power utilizing load according to the selection signal;

wherein if the comparison result indicates that the voltage of the solar electric power is greater than the predetermined value, the multiplexer generates a first link connecting the output end with the first input end, otherwise the multiplexer generates a second link connecting the output end with the second input end.

13. A hybrid power supply method for providing electric power to a light-emitting diode (LED) module by a hybrid power supply device including a solar module, an auxiliary power module, a first switch unit, a second switch unit, and a voltage level detection circuit, in which the first switch unit is electrically connected between the solar module and the LED module, and the second switch unit is electrically connected between the auxiliary power module and the LED module, the method comprising:

comparing a voltage of a solar electric power generated by the solar module with a predetermined value by the voltage level detection circuit, for generating a comparison result; and controlling the first switch unit and the second switch unit according to the comparison result by the voltage level detection circuit, for determining whether to transmit the solar electric power generated by the solar module or an auxiliary electric power generated by the auxiliary power module to the LED module;

wherein when the voltage of the solar electric power is greater than the predetermined value causing the voltage level detection circuit to turn on the first switch unit and to turn off the second switch unit, for transmitting the solar electric power to the LED module, otherwise causing the voltage level detection circuit to turn off the first switch unit and to turn on the second switch unit, for transmitting the auxiliary electric power to the LED module.

14. The hybrid power supply method as in claim 13, further comprising:

controlling a power leakage unit by the voltage level detection circuit for discharging electric power stored in the solar module when the first switch unit is turned off and the second switch unit is turned on.

15. The hybrid power supply method as in claim 13, further comprising:

detecting an environmental light intensity by a photo sensor unit of the hybrid power supply device; and stopping the auxiliary power module from operating by the photo sensor unit when the environmental light intensity is greater than a threshold value.

* * * * *